United States Patent [19]

Hosokawa et al.

[11] 3,970,816

[45] July 20, 1976

[54] ELECTRIC HEATER FOR HEATING LUBRICATING OILS

[76] Inventors: Hisashi Hosokawa, 2-7, 4-chome, Nishi-ochiai, Shinjuku, Tokyo; Eicho Iijima, 9-6, 7-chome, Shakujii-cho, Nerima, Tokyo, both of Japan

[22] Filed: June 10, 1974

[21] Appl. No.: 477,704

[52] U.S. Cl. ..... 219/205; 123/142.5 E; 184/105 R; 219/338; 219/523; 338/264; 338/270

[51] Int. Cl.[2] ..... H05B 3/02; F01M 5/02; F02N 17/04

[58] Field of Search ..... 219/202, 205, 208, 316, 219/335, 336, 338, 523, 354–557; 338/257, 258, 269, 270, 264, 263; 123/142.5 R, 142.5 E; 184/105

[56] References Cited

UNITED STATES PATENTS

| | | | |
|---|---|---|---|
| 1,322,073 | 11/1919 | Stuart | 338/264 X |
| 1,517,301 | 12/1924 | McMichael et al. | 219/205 X |
| 1,751,859 | 3/1930 | Nelson et al. | 219/205 |
| 1,759,389 | 5/1930 | Bowen | 123/142.5 E |
| 1,782,218 | 11/1930 | Suter et al. | 338/269 X |
| 1,828,635 | 10/1931 | Abbott | 338/270 X |
| 1,894,887 | 1/1933 | Pingrey | 123/142.5 E |
| 1,995,000 | 3/1935 | Hyatt | 219/335 X |
| 2,030,937 | 2/1936 | Reichmann | 219/205 X |
| 2,195,705 | 4/1940 | Morgan | 338/264 X |
| 3,769,493 | 10/1973 | Zeitlin | 219/335 |

FOREIGN PATENTS OR APPLICATIONS

| | | | |
|---|---|---|---|
| 824,976 | 12/1951 | Germany | 219/354 |

*Primary Examiner*—A. Bartis

[57] ABSTRACT

An oil heater for heating lubricating oils having infrared energy absorbtion peaks within infrared wavelengths ranging from 2.5 to at least 15 microns comprises an electrical infrared heating element coupled to an oil cock and adapted to contact the oil within an oil reservoir containing the oil to be heated when the oil cock is seated in an opening in the reservoir. The infrared heating element has an infrared imission spectrum at 400°C ranging from 2.5 to at least 15 microns to match the infrared absorption spectrum of the oil contained in the reservoir and the relative strength of the radiation emitted between the wavelengths of 5–15 microns average at least 50% of the relative strength of the radiation emitted between the wavelength 2.5 to 4 microns.

9 Claims, 8 Drawing Figures

ELECTRIC HEATER FOR HEATING LUBRICATING OILS

BACKGROUND OF THE INVENTION

Almost every engine of motor cars, tanks, ships, airplanes and usual machinery has a lubrication oil in it. Various techniques have been tried to make the lubricating oil warm enough at the time when the engine is to be started. In emergency such as patrol cars or lifeboats which require instantaneous starting, a very simple or even primitive way has been used to get their engines started at the time an emergency by warming them from the outside with a portable oil stove.

In the winter season in cold districts, it is difficult to start engines of motor cars or tanks with a single cranking of the engine. That is because the viscosity of the lubricating oil contained in the oil pan is too high. If such lubricating oil contained inside the engines is forced to be agitated, its durability is reduced, a knocking may be caused during starting and fuel is wasted.

The present inventors, considering the above facts, have succeeded in making an oil cock which can bring an engine into an temperature condition rapidly without injuring its mechanism.

SUMMARY OF THE INVENTION

A primary object of the present invention is to provide an oil cock having a ceramic coupling thereto which serves to warm the lubricating oil of an engine up to a temperature to bring the engine into an operatable temperature condition rapidly.

Another object of the present invention is to provide an oil cock having a ceramic heater coupling thereto which is capable of radiating long wave infrared rays from $3\mu$ to $100\mu$ long at a temperature higher than 30°C, the wave range falling within the infrared absorption spectrum where substantial infrared energy absorption occurs within various types of lubricating oil for engines.

Still further objects of the present invention will be apparent from the following description and the attached drawings.

DETAILED EXPLANATION OF THE INVENTION

Figure 1:
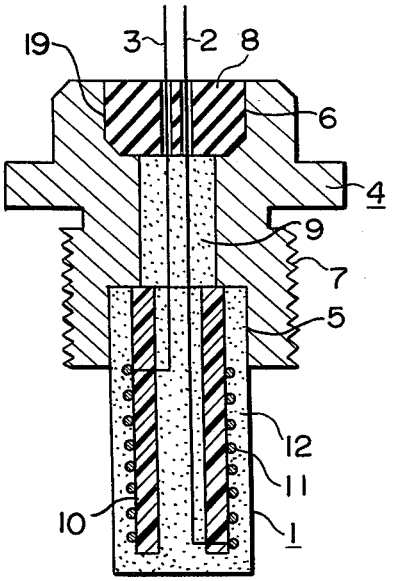
FIG. 1 is a sectional view of a first embodiment of an oil cock having a ceramic heater coupled thereto which is capable of radiating long wave infrared rays according to the present invention.

Ceramic heater 1 consists of bobbin 10 made of earthenware or a combination of heat-resistant and electric-insulating material and adhesive, Nichrome wire 11 which is coiled on the outer surface of bobbin 10, and ceramic 12 which covers bobbin 10 and Nichrome wire. The ceramic heater 1 radiates long wave infrared rays when heated (the way of coating will be described later). The inside bobbin 10 is filled with the ceramic 12. The two ends of Nichrome wire 11 extend from the heater 1 up through filling layer 9 and fixing layer 8 into a point external to the cock.

Figure 2:
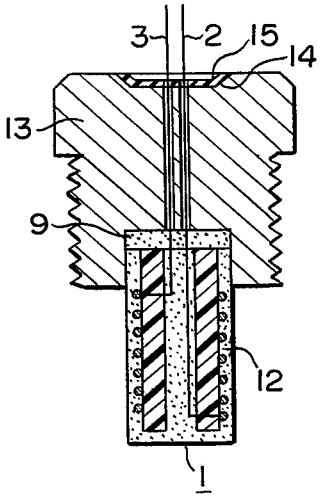
FIG. 2 is a sectional view of the second embodiment of the present invention.

In the embodiment shown in FIG. 2 there is used a brimless cock 13 not having a portion 6 for installing a fixing material 8 as illustrated in FIG. 1. At the upper recess of cock 13, there is provided a hollow part into which a cover 15 made of synthetic rubber or plastic is cemented with a heat-resistant adhesive. . Such a cover functions in the same manner as the fixing material 8 illustrated in FIG. 1.

Figure 3:
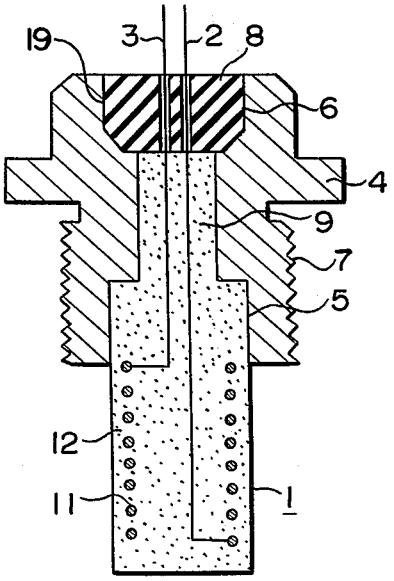
FIG. 3 is a sectional view of the third embodiment of the present invention.

In FIG. 3, a different type of ceramic heater is used. It has no bobbin, and is made by coating on a coil of Nichrome wire a paste which is prepared by mixing and kneading a mixture of heat-resistant and electric-insulating adhesive and ceramic one or more materials which are capable of radiating long wave infrared rays.

Figure 4:
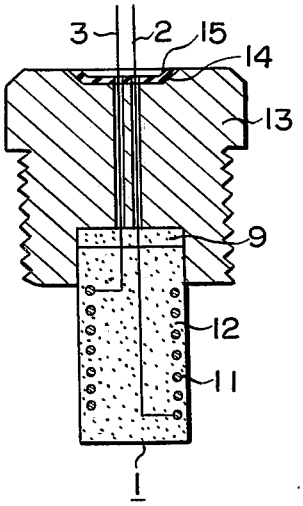
FIG. 4 is a sectional view of the fourth embodiment of the present invention.

FIG. 4 shows the same type of oil cock as in FIG. 2 except that its heater 1 is identical to the heater that is used in FIG. 3.

Through FIGS. 1 to 4 the threads 4 are formed in such a manner that they are attached to engage a threaded portion in the oil pan to which the oil cock is to be inserted.

It is possible to replace hollow brimmed cock 4 in FIGS. 1 and 3 by the oil cock in FIGS. 2 and 4 that has only two holes for passing wires 2 and 3. Also oil cock 13 in FIGS. 2 and 4 can be replaced by the brimmed cock 4 shown in FIGS. 1 and 3.

To portion 5 of brimmed cock 4 or to cock 13, a ceramic heater is attached by either a heat-resistant adhesive or by an interference fit.

A heat-resistant filling layer 9 is further provided within the oil cock, between the ceramic heater and the top of the oil cock so that lubricating oil does not leak through the oil cock.

Figure 5:
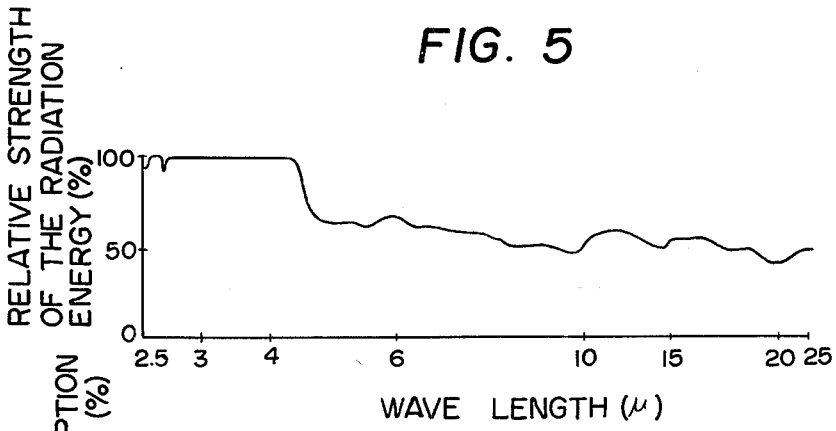
FIG. 5 is a graph showing a relative strength of an energy radiated from the oil cock as shown in FIG. 1 as a function of wavelengths.

FIG. 5 shows relative strength of energy emitted from ceramic heater used in the embodiments illustrated in FIGS. 1 to 4 at 400°C. From the graph it can be seen that the ceramic heater can emit long wave infrared rays that correspond with the absorption spectrum of a lubricating oil such as motor oil (FIG. 6. PAN-X Motor oil, SE True Multigrade Motor oil, 10w–40, NIPHON SEKIYU K.K.). When the ceramic heater is activated after the oil cock is attached to an oil pan, it radiates long wave infrared rays to warm the lubricating oil rapidly to such a temperature that the engine is of a low enough viscosity to permit the engine to be started.

FIG. 5 illustrates that very strong energy can be radiated in the long wave area of infrared radiation. In the conventional infrared ray lamp, most of the waves radiated are less than $1.12\mu$ long and hence most of the energy is radiated in wave lengths less than $3\mu$. It will be seen that the infrared ray heater incorporating the oil cock according to the present invention has a great advantage over conventional ones in emitting radiation over $3\mu$.

As may be seen from inspection of FIG. 5, the oil heater of the present invention emits radiation from 2.5 $\mu$ to at least $25\mu$ in which the relative strength of the radiation emitted between the wavelengths $5\mu$ to $25\mu$ averages at least approximately 50% of the relative strength of the radiation emitted between 2.5$\mu$ and 4$\mu$.

Figure 6:
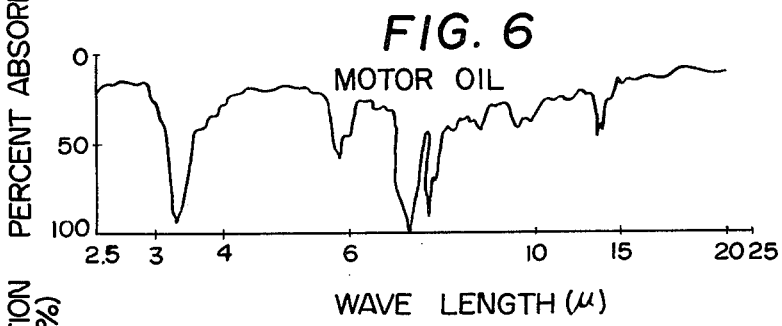
FIG. 6 shows an infrared rays absorption spectrum of motor oil.
Figure 7:
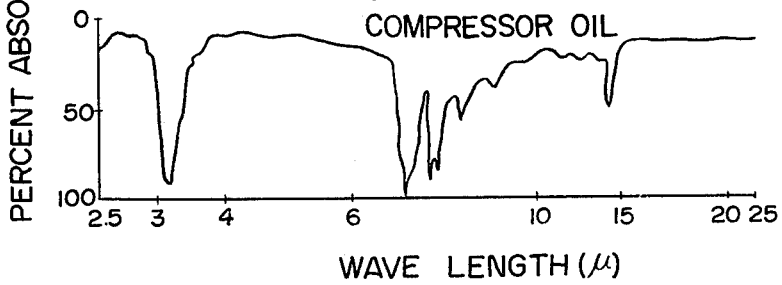
FIG. 7 shows an infrared rays absorption spectrum of compressor oil.

As stated already, FIGS. 6 and 7 show infrared absorption spectrums of engine oil and compressor oil respectively. Everyone of these lubricating oils has some long wave areas or bands raging from 3$\mu$ to 15$\mu$ where infrared rays are absorbed well.

Accordingly, when the infrared rays are projected by the ceramic heater against these lubricating oils, every wave can be absorbed to the greatest possible extent so that a violent resonation phenomenon occurs in the molecules of these substances to promote the heating effect.

A ceramic material for use in the present invention is one capable of radiating long wave infrared rays of from 3$\mu$ to 100$\mu$ long at temperatures higher than 30°C. The ceramic material is a powder or particles of a mixture, melt or solid solution of one or more substances which are so selected that the length of infrared energy emitted from the ceramic layer corresponds with the long wave infrared absorption spectrum of the lubricating oils to treated. The suitable substances are inorganic compounds such as of carbides, nitrides, borides, oxides and sulfides of an alkaline earth metal element, aluminium family element, carbon family element, titanium family element, vanadium family element, chromium family element, iron family element or an actinide series element.

More specifically the carbides include boron carbide, beryllium carbide, chromium carbide, hafnium carbide, molybdenum carbide, niobium carbide, silicon carbide, tantalum carbide, thorium carbide, titanium carbide, uranium carbide, vanadium carbide, tungsten carbide, zirconium carbide, etc.: the nitrides include boron nitride, beryllium nitride, chromium nitride, hafnium nitride, niobium nitride, silicon nitride, tantalum nitride, thorium nitride, titanium nitride, uranium nitride, vanadium nitride, zirconium nitride, etc.: the borides include chromium boride, hafnium boride, molybdenum boride, niobium boride, tantalum boride, thorium boride, titanium boride, uranium boride, vanadium boride, tungsten boride, zirconium boride, etc.: the oxides include boron oxide, beryllium oxide, chromium oxide, hafnium oxide, silicon oxide, tantalum oxide, thorium oxide, titanium oxide, uranium oxide, vanadium oxide, zirconium oxide, calcium oxide, iron oxide, manganese oxide, nickel oxide, strontium oxide, molybdenum oxide, magnesium oxide, etc.: and the sulfides include iron sulfide, cadmium sulfide, chromium sulfide, cobalt sulfide, strontium sulfide, selenium sulfide, etc.

When bobbin is used as in FIGS. 1 and 2, ceramic powder or particles of the above substances are lined on the surface of resistance wire to form a ceramic layer of 30$\mu$ to 1000$\mu$ in thickness by the following methods: fusing and spraying electric-insulating ceramic powder by means of a plasma jet spraying process or a flame spraying process; coating the paste prepared by mixing and kneading 30 to 90 percent by weight of electric-insulating ceramic particles and 10 to 70 percent by weight of binder.

When the bobbin is not used as in FIGS. 3 and 4, the resistance wire is covered with a paste that is prepared by mixing and kneading 30 to 90 percent by weight of electric-insulating ceramic powder or particles of the above substances with 10 to 70 percent by weight of electric-insulating and heat-resistant adhesive. Moreover, the resistance wire may be further provided with a ceramic layer of 30$\mu$ to 1000$\mu$ in thickness by fusing and spraying electric-insulating ceramic powder or particles by means of a plasma jet spraying process or flame spraying process. In this case, the preferable paste is that which is prepared by mixing and kneading 70 to 90 percent by weight of zircon and 10 to 30 percent by weight of aluminum phosphate (50 percent aqueous solution).

Effective insulating adhesive to used in the ceramic heater include organic or inorganic adhesives such as CERAMADIP or CERAMACOAT (U.S.A. AREMCO PRODUCTS, INC.), TEC COAT (JAPAN THERMO TEC COMPANY), furan resins, phenolic resins, ammonium phosphate, aluminum phosphate, etc.

The ceramic heater of the present invention (FIGS. 1 and 2) is made for example in the following manner. Paste prepared by mixing and kneading electric-insulating and heat-resistant ceramics (an average of particle diameter: 200 – 400 mesh) with aluminum phosphate (50 percent aqueous solution) at the amount ratio as shown in Table 1 infra, is shaped into a bobbin having about 12 mm diameter, 3 mm thickness and about 30 mm height. The shaped bobbin is dried in a desiccator at about 150° to 250°C for about 90 to 120 minutes. The obtained bobbin shows an electric resistance value from 100 to $\infty$ M $\Omega$ at the temperature range from 0° to 800°C. Along the outer periphery of the bobbin, Nichrome wire of 12 V and 40 W is coiled. Then the outer surface of the bobbin and Nichrome wire, as shown in FIGS. 1 and 2, is coated or covered with a paste that is prepared by mixing and kneading 70 to 90 percent by weight of zircon having about 200 to 400 mesh (an average of particle diameter) and 10 to 30 percent by weight of aluminum phosphate (50 percent aqueous solution). Also the inside of the bobbin is filled with the paste. The bobbin is again dried in desiccator at about 150° to 200°C for about 90 to 120 minutes. The thickness of the ceramic coat is about 0.1 to 2 mm.

The ceramic heater of the present invention (FIGS. 3 and 4) is made for example in the following manner. Nichrome wire of 12 V and 40 W is coiled as shown in FIGS. 3 and 4. Then Nichrome wire is coated or covered with a paste that is prepared by mixing and kneading 70 to 90 percent by weight of zircon having about 200 to 400 mesh (an average of perticle diameter) and 10 to 30 percent by weight of aluminum phosphate (50 percent aqueous solution). A ceramic heater is shaped in this way. The ceramic heater is about 12 mm diameter and about 30 mm height. The shaped ceramic heater is dried in a desiccator at about 150° to 250°C for about 90 to 120 minutes.

Table 1

| | Heat-resistant and electric-insulating ceramic (per cent by weight) | | | | | Aluminum phosphate (50% aqueous solution) (per cent by weight) |
|---|---|---|---|---|---|---|
| NO. | Almina | Zircon | Zirconia | Beryllium oxide | Magnesium oxide | |
| 1 | 90 | | | | | 10 |

Table 1-continued

| NO. | Heat-resistant and electric-insulating ceramic (per cent by weight) Almina | Zircon | Zirconia | Beryllium oxide | Magnesium oxide | Aluminum phosphate (50% aqueous solution) (per cent by weight) |
|---|---|---|---|---|---|---|
| 2 | 87 | | | | | 13 |
| 3 | 85 | | | | | 15 |
| 4 | 80 | | | | | 20 |
| 5 | 70 | | | | | 30 |
| 6 | | 90 | | | | 10 |
| 7 | | 87 | | | | 13 |
| 8 | | 85 | | | | 15 |
| 9 | | 80 | | | | 20 |
| 10 | | 70 | | | | 30 |
| 11 | | | 90 | | | 10 |
| 12 | | | 87 | | | 13 |
| 13 | | | 85 | | | 15 |
| 14 | | | 80 | | | 20 |
| 15 | | | 70 | | | 30 |
| 16 | | | | 90 | | 10 |
| 17 | | | | 87 | | 13 |
| 18 | | | | 85 | | 15 |
| 19 | | | | 80 | | 20 |
| 20 | | | | 70 | | 30 |
| 21 | | | | | 90 | 10 |
| 22 | | | | | 87 | 13 |
| 23 | | | | | 85 | 15 |
| 24 | | | | | 80 | 20 |
| 25 | | | | | 70 | 30 |

The heat resistant filling layer 9 is formed from a paste which is made by mixing and kneading inorganic substances such as aluminum oxide, beryllium oxide, magnesium oxide, zircon, cordierite and organic or inorganic adhesive such as CERAMADIP, CERAMBAIT or CERAM COAT (U.S.A. AREMCO PRODUCTS INC.), TEC COAT (JAPAN THERMO TEC COMPANY), furan resins, phenolic resins, ammonium phosphate, aluminum hydroxy chloride, ethyle silicate, etc., or from the above mentioned organic or inorganic adhesive.

Fixing material 8 shown in FIGS. 1 and 3 is made of mechanically strong material, that is, having rigidity, shock-resistance and abrasion-resistance. The examples of such material include polyacetate, fiber glass reinforced plastic, acrylic resin, polyamid resin, etc.

Cock 4 or 13 is made of stainless steel, steel, iron, brass or the like which is the material that usually is employed for making an oil cock.

The lubricating oils referred to in the present invention are those which are commonly used. They include for example spindle oil, refrigerating machine oil, compressor oil, dynamo oil, turbin oil, machine oil, motor oil, engine oil, cylinder oil, marine engine oil, gear oil, aviation engine oil, jet engine oil, hydraulic oil, etc.; or compounded lubricating oil; or synthetic lubricating oil such as olefin polymer oil, diester oil, hydrocarbon hologenide oil.

Figure 8:
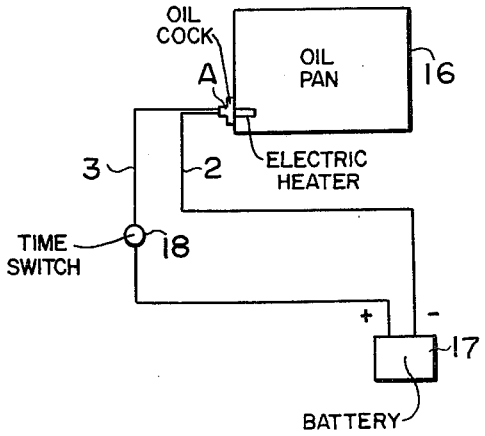
FIG. 8 is an explanatory view of how to use the oil cock of the present invention.

FIG. 8 shows an example of the case where the oil cock according to the present invention is attached to a vehicle. Oil cock A is engaged in the oil pan 16 in the same manner as conventional oil cocks. Wire 2 is connected to a negative pole of battery 17. Wire 3 is connected to a positive pole through a time-switch 18 provided on a dash-board.

Prior to starting a vehicle's engine, time-switch 18 which has been previously set to a proper time range depending upon the temperature around the vehicle, operates to give electric current to ceramic heater so that motor oil in oil pan 16 is warmed by the heater up to a temperature suitable for starting the engine. Thus, the engine can be started at one operation and the interior temperature of the vehicle can be elevated very soon.

Explaining in more detail, oil cock A is provided with ceramic heater which is 3 cm high and 12 mm in diameter and is coiled with Nichrome wire of 12 V electric current and 40 W input. The oil cock A is connected to a battery 17. When tested under conditions when the outdoor temperature was −20°C and the quantity of motor oil (PAN-X Motor Oil SE True Multigrade Motor Oil 10w–40. NIPHON SEKIYU K.K.) in the oil pan of a vehicle was 2 liters, the oil cock elevated the temperature of the motor oil to 10°C in about 20 minutes and the engine started with one operation. During the running of the vehicle, there occurred no knocking. The surface temperature of the ceramic heater at the time of testing was 400°C in the atmosphere.

Advantages of an oil cock constructed to the present invention are summarized as follows:

1. Idling of engine is not needed.
2. There is no problem with over-heating the oil engine trouble because the time-switch disables the operation of the oil cock completely except when it is required.
3. There are no problems with leakage of oil because both the ceramic heater and the fixing material are bonded to the oil cock by adhesive.
4. The oil cock is simple and compact in structure, so it can be attached easily at the time of oil-change as for example at a gas station.

What is claimed is:

1. An oil heater for heating lubricating oils having infrared energy absorption peaks within infrared wavelengths ranging from 2.5 $\mu$ to at least 15 $\mu$ comprising:

a. an oil cock having a top section and a bottom section, said bottom section being adapted to sealingly engage an opening in the wall of an oil reservoir; and b. an electrical infrared heating element coupled to said oil cock and adapted to contact said oil contained within said oil reservoir when said cock engages said opening in the wall of said reservoir, said heating element having an infrared emission spectrum at 400°C ranging from 2.5μ to at least 15μ to match the infrared absorption spectrum of the oil contained in the reservoir and in which the relative strength of the radiation emitted between the wavelengths 5μ–15μ averages at least approximately 50% of the relative strength of the radiation emitted between 2.5μ and 4μ.

2. An oil heater as recited in claim 1 wherein said heating element comprises:

an insulative hollow bobbin having an inside and an outside surface;

b. at least one turn of resistive electrical heating wire coiled on the outside surface of said bobbin; and c. a layer comprised of at least one ceramic infrared emissive material engaging the inside and outside surfaces of said bobbin, said layer of ceramic material being capable of emitting infrared radiation from 2.5μ to at least 15μ at temperatures higher than 30°C; and said layer completely covering the at least one turn of resistive heating wire and forming a surface which engages a recess contained in said oil cock.

3. An oil heater as recited in claim 2 wherein:

a. said ceramic materials are chosen from the group consisting of boron carbide, beryllium carbide, chromium carbide, hafnium carbide, molybdenum carbide, niobium carbide, silicon carbide tantalum carbide, thorium carbide, titanium, carbide, uranium carbide, vanadium carbide, tungsten carbide, zirconium carbide, boron nitride, beryllium nitride, chromium nitride, hafnium nitride, niobium nitride, silicon nitride, tantalum nitride, thorium nitride, titanium nitride, uranium nitride, vanadium nitride, zirconium nitride, chromium boride, hafnium boride, molybdenum boride, niobium boride, tantalum boride, thorium boride, molybdenum boride, niobium boride, tantalum boride, thorium boride, titanium boride, uranium boride, vanadium boride, tungsten boride, zirconium boride, boron oxide, beryllium oxide, chromium oxide, hafnium oxide, silicon oxide, tantalum oxide, thorium oxide, titanium oxide, oxide, silicon oxide, tantlum oxide, thorium oxide, titanium oxide, uranium oxide, vanadium oxide, zirconium oxide, calcium oxide, iron oxide, manganese oxide, nickel oxide, strontium oxide, molybdenum oxide, magnesium oxide, iron sulfide, candium sulfide, chromium sulfide, cobalt sulfide, strontium sulfide, and selenium sulfide.

4. An oil heater as recited in claim 1 wherein said heating element comprises:

a. at least one turn of resistive electrical heating wire wound in a coiled configuration;

b. a layer covering the resistive electrical heating wire, and forming a surface which engages said oil cock, said layer comprising a mixture of at least one ceramic material and an insulating and heat resistive adhesive, said layer of ceramic material being capable of emitting infrared radiation from 2.5μ to at least 15μ at temperatures higher than 30°C; and wherein c. said heating element is disposed in a recess located in said bottom section of said oil cock.

5. An oil heater as recited in claim 4 wherein:

a. said ceramic materials are chosen from the group consisting of boron carbide, beryllium carbide, chromium carbide, hafnium carbide, molybdenum carbide, niobium carbide, silicon carbide, tantalum carbide, thorium carbide, titanium carbide, uranium carbide, vanadium carbide, tungsten carbide, zirconium carbide, boron nitride, beryllium nitride, chromium nitride, hafnium nitride, niobium nitride, silicon nitride, tantalum nitride, thorium nitride, titanium nitride, uranium nitride, vanadium nitride, zirconium nitride, chromium boride, hafnium boride, molybdenum boride, niobium boride, tantalum boride, thorium boride, titanium boride, uranium boride, vanadium boride, tungsten boride, zirconium boride, boron oxide, beryllium oxide, chromium oxide, hafnium oxide, silicon oxide, tantalum oxide, throium oxide, titanium oxide, uranium oxide, vanadium oxide, zirconium oxide, calcium oxide, iron oxide, manganese oxide, nickel oxide, strontium oxide, molybdenum oxide, magnesium oxide, iron sulfide, cadium sulfide, chromium sulfide, cobalt sulfide, strontium sulfide, and selenium sulfide;

b. said insulating and heat resistive adhesive being chosen from the group consisting of organic adhesives, inorganic adhesives, furan resins, phenolic resins, and ammonium phosphate.

6. An oil heater as recited in claim 1 further comprising:

a. a recess disposed in said bottom section of said oil cock;

b. a pair of electric leads coupled to said heating element and extending through the top section of said cock to a point external to the oil reservoir; and c. a layer of heat resistant filling material disposed in said recess, said layer being located between said heating element and said top section of said oil cock.

7. An oil heater as recited in claim 6 further comprising:

a. a recess disposed in said top section of said cock;

b. a section of polymeric fixing material inserted into said recess in said top section of said cock; and c. a layer of heat resistant adhesive joining said section of polymeric fixing material to said recess in said top section of said cock.

8. An oil heater as recited in claim 15 further comprising:

a. a recess disposed in said top section of said cock;

b. a cover of polymeric material inserted into said recess in said top section of said cock; and c. a layer of heat resistant adhesive joining said cover of polymeric material to said recess top section of said cock.

9. In an oil heater as recited in claim 9 further comprising:

a. a time switch having an input and an output;

b. a battery having first and second electrodes;

c. said first electrode being coupled to the input of said time switch; and d. a pair of output leads electrically coupled to said electrical infrared heating element, one of said output leads being coupled to the output of said time switch, the other output lead being coupled to said second electrode.

* * * * *